US007609997B2

(12) United States Patent
Otake et al.

(10) Patent No.: US 7,609,997 B2
(45) Date of Patent: Oct. 27, 2009

(54) TRANSFER BELT UNIT MOUNTING/DISMOUNTING DEVICE AND METHOD

(75) Inventors: Yoshihisa Otake, Shizuoka-ken (JP); Satoshi Kaiho, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 252 days.

(21) Appl. No.: 11/694,560

(22) Filed: Mar. 30, 2007

(65) Prior Publication Data

US 2007/0231000 A1 Oct. 4, 2007

(30) Foreign Application Priority Data

Mar. 30, 2006 (JP) ..... 2006-095222

(51) Int. Cl.
*G03G 15/08* (2006.01)

(52) U.S. Cl. ..... 399/121; 399/302; 399/308

(58) Field of Classification Search ..... 399/107, 399/110, 121, 297, 302, 308
See application file for complete search history.

(56) References Cited

U.S. PATENT DOCUMENTS 6,711,367 B2 * 3/2004 Saito et al. ..... 399/121
7,054,578 B2 * 5/2006 Jung et al. ..... 399/110

FOREIGN PATENT DOCUMENTS

JP 11-352741 12/1999

* cited by examiner

*Primary Examiner*—Hoan H Tran
(74) *Attorney, Agent, or Firm*—Turocy & Watson, LLP

(57) ABSTRACT

There is provided a transfer belt unit mounting/dismounting device constituted by a decreased number of component parts capable of using the guide rails not only to guide the insertion of the transfer belt unit, but also to set the transfer belt unit to a transfer position and to return it to a non-transfer section.

13 Claims, 10 Drawing Sheets

TRANSFER BELT UNIT MOUNTING/DISMOUNTING DEVICE AND METHOD

BACKGROUND OF THE INVENTION

1. Field of the Invention

The present invention relates to a transfer belt unit mounting/dismounting device, and particularly, to a transfer belt unit mounting/dismounting device provided in a transfer belt unit mounting/dismounting section of an image forming apparatus using a photo conductor.

2. Description of the Related Art

In a conventional transfer belt unit mounting/dismounting device provided in a transfer belt unit mounting/dismounting section of an image forming apparatus using a photo conductor, after a transfer belt unit has been inserted by being guided by a guide rail provided in the transfer belt unit mounting/dismounting device, another mechanism than the guide rail sets the transfer belt unit to a transfer position to bring the transfer belt into contact with a photo conductor drum.

As described above, the conventional transfer belt unit mounting/dismounting device uses another mechanism than the guide rail to set the transfer belt unit to the transfer position so as to bring the transfer belt into contact with the photo conductor drum. The use of the additional mechanism increases the number of component parts and is not efficient.

SUMMARY OF THE INVENTION

An embodiment of the present invention has an object of providing a transfer belt unit mounting/dismounting device including decreased number of component parts by using guide rails not only to guide the transfer belt unit, but also to set the transfer belt unit to the transfer position and to return it to a non-transfer position.

In order to solve the above problem, a transfer belt unit mounting/dismounting device according to one embodiment of the present invention is the transfer belt unit mounting/dismounting device that mounts and dismounts a transfer belt unit to and from an image forming apparatus and is configured to comprise: a guide section that is provided in a predetermined mounting position of the image forming apparatus to guide a transfer belt unit inserted in a predetermined direction by a guide surface, the guide surface having first positioning sections thereon that are formed to position the transfer belt unit located in a predetermined position on the guide surface with respect to the image forming apparatus; a moving mechanism that moves the guide section between a first position for guiding the insertion of the transfer belt unit in the predetermined direction by the guide surface and a second position for positioning the transfer belt unit by the first positioning sections; and second positioning sections that cooperate with the first positioning sections in the guide section moved to the second position by the moving mechanism to position the transfer belt unit with respect to the image forming apparatus.

In addition, a transfer belt unit mounting/dismounting device according to one embodiment of the present invention is the transfer belt unit mounting/dismounting device that mounts and dismounts a transfer belt unit to and from an image forming apparatus and is configured to comprise: a guide means provided in a predetermined mounting position of the image forming apparatus for guiding a transfer belt unit inserted in a predetermined direction by a guide surface, the guide surface having first positioning means thereon that are formed to position the transfer belt unit located in a predetermined position on the guide surface with respect to the image forming apparatus; a moving means for moving the guide means between a first position for guiding the insertion of the transfer belt unit in the predetermined direction by the guide surface and a second position for positioning the transfer belt unit by the first positioning means; and second positioning means for cooperating with the first positioning section in the guide section moved to the second position by the moving mechanism to position the transfer belt unit with respect to the image forming apparatus.

In addition, an image forming apparatus according to one embodiment of the present invention is configured to comprise: a transfer belt unit mounting/dismounting device configured as described above; a photo conductor that is arranged below the mounting position of the transfer belt unit in the transfer belt unit mounting/dismounting device and transfers a toner image onto the belt surface of a transfer belt constituting the transfer belt unit; and a transfer roller that transfers the toner image transferred onto the belt surface of the transfer belt to a sheet.

Further, a transfer belt unit mounting/dismounting method according to one embodiment of the present invention is the method of mounting and dismounting a transfer belt unit to and from an image forming apparatus, comprising: supporting the transfer belt unit from one of above and below by first positioning sections that are formed on a guide surface to position the transfer belt unit with respect to the image forming apparatus, the transfer unit being located in a predetermined position of on a guide surface of a guide section that guides the transfer belt unit inserted in a predetermined direction with respect to a predetermined mounting position in the image forming apparatus; and then supporting the transfer belt unit from the other of above and below by second positioning sections that position the transfer belt unit with respect to the image forming apparatus by cooperating with the first positioning sections in the guide section, the first positioning sections having been moved to a second position by a moving mechanism that moves the guide section between a first position for guiding the insertion of the transfer belt unit in the predetermined direction by the guide surface and a second position for positioning the transfer belt unit by the first positioning sections.

DESCRIPTION OF THE EMBODIMENT

Figure 1:
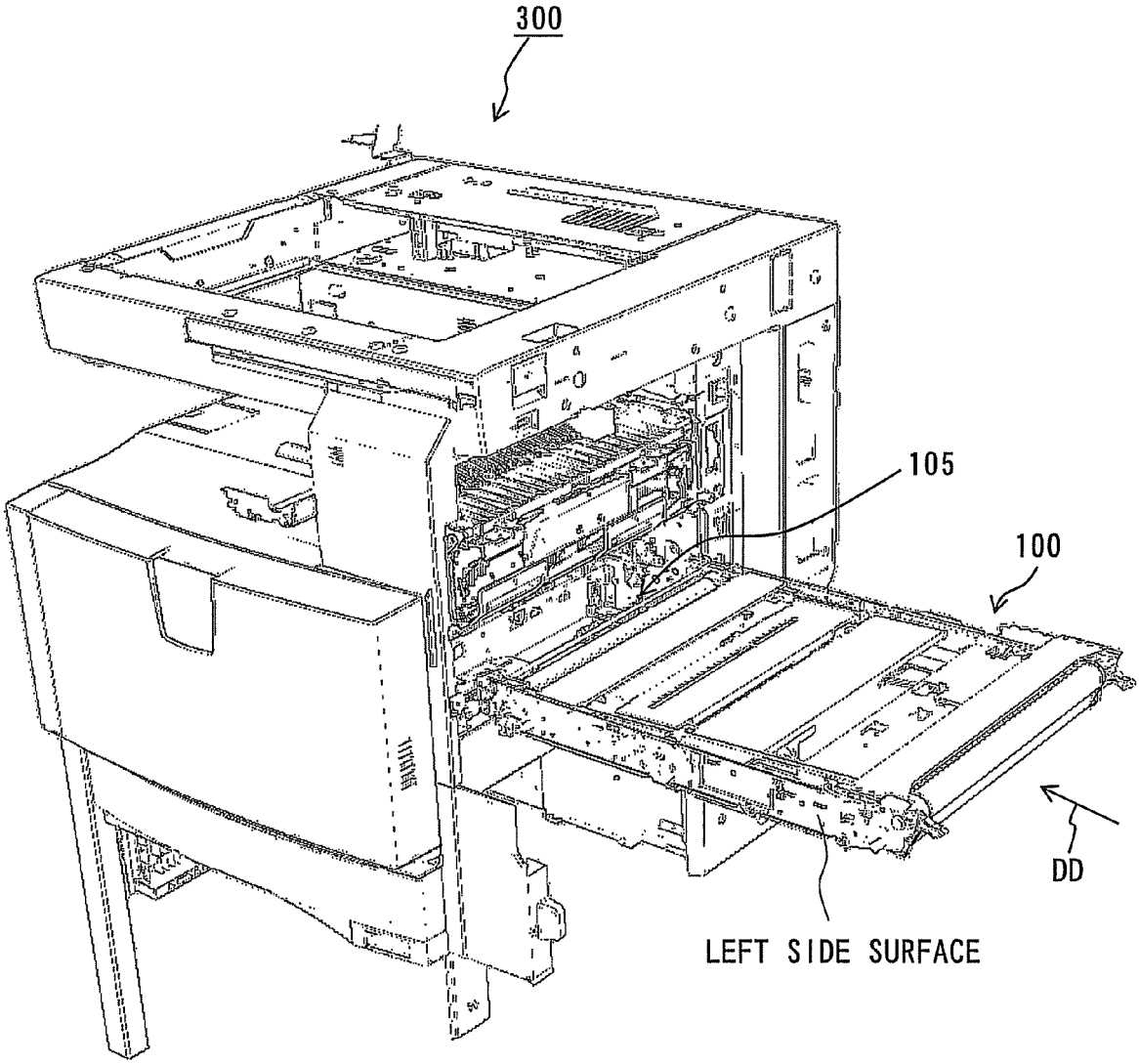
FIG. 1 is an outline view showing an image forming apparatus to which an embodiment of a transfer belt unit mounting/dismounting device according to the present invention is applied.
Figure 2:
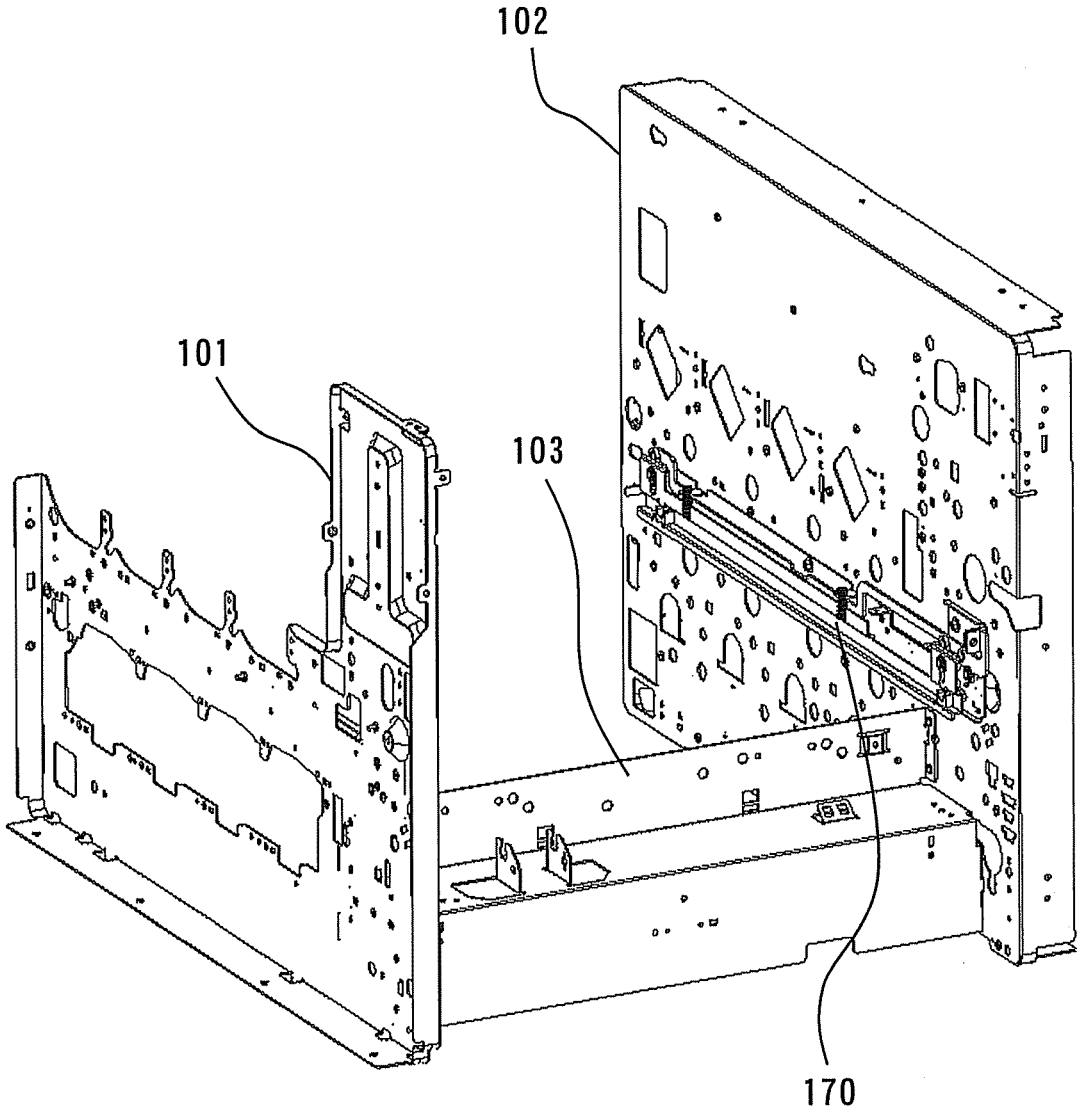
FIG. 2 is a view showing a relationship between frames and one guide rail of the transfer belt unit mounting/dismounting device of FIG. 1.
Figure 3:
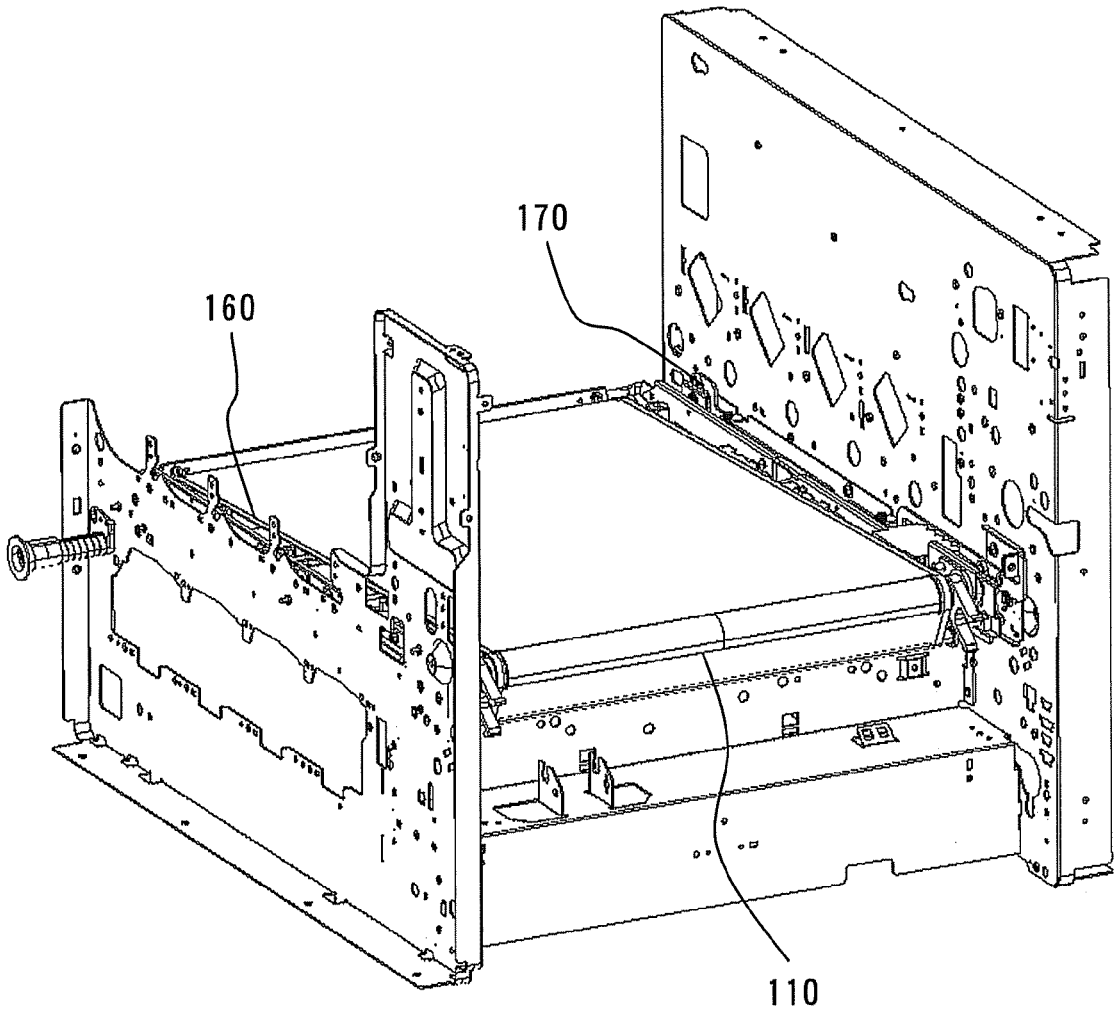
FIG. 3 is a view showing a state where the transfer belt unit is inserted into the guide rail shown in FIG. 2.
Figure 4:
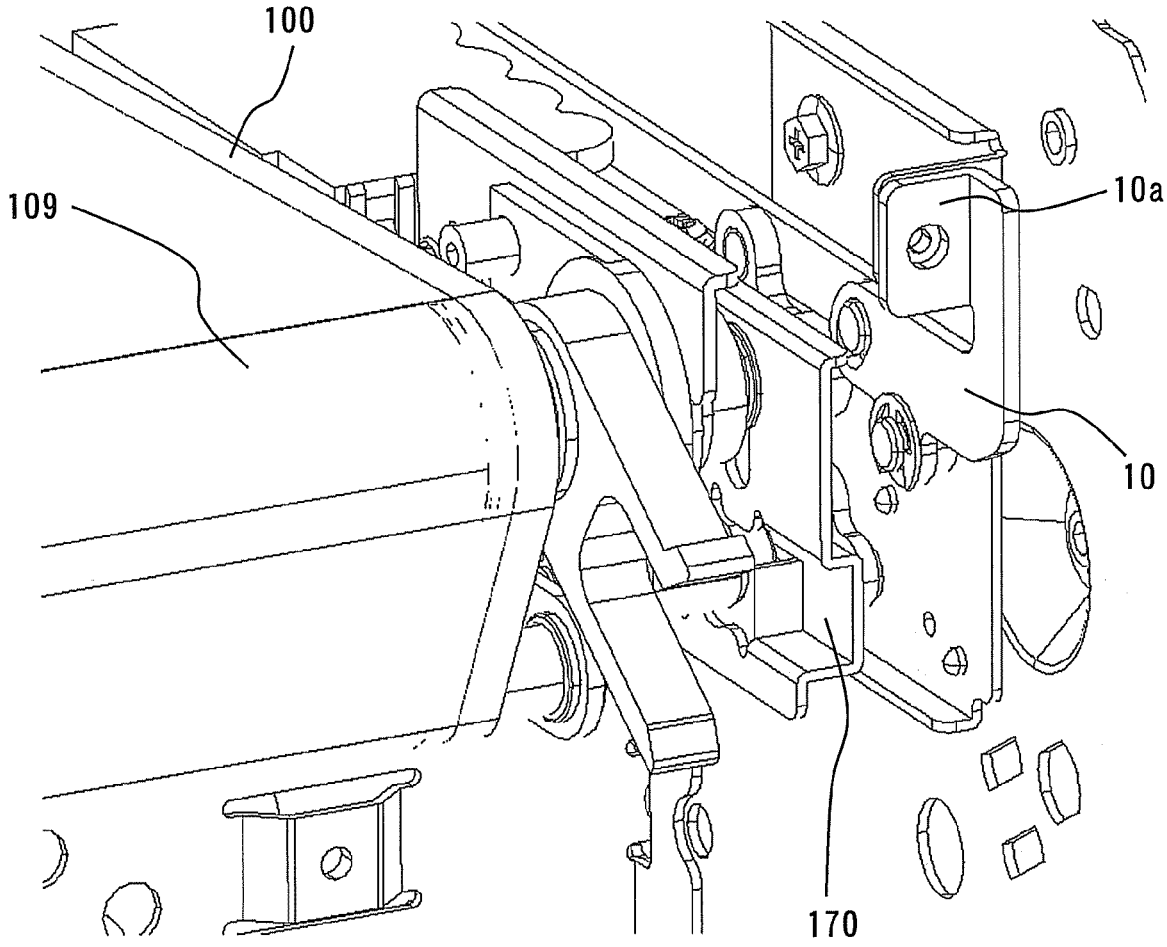
FIG. 4 is a view showing a state where an operation terminal of a lifting lever has been turned upward to set the transfer belt unit to a transfer position.
Figure 5:
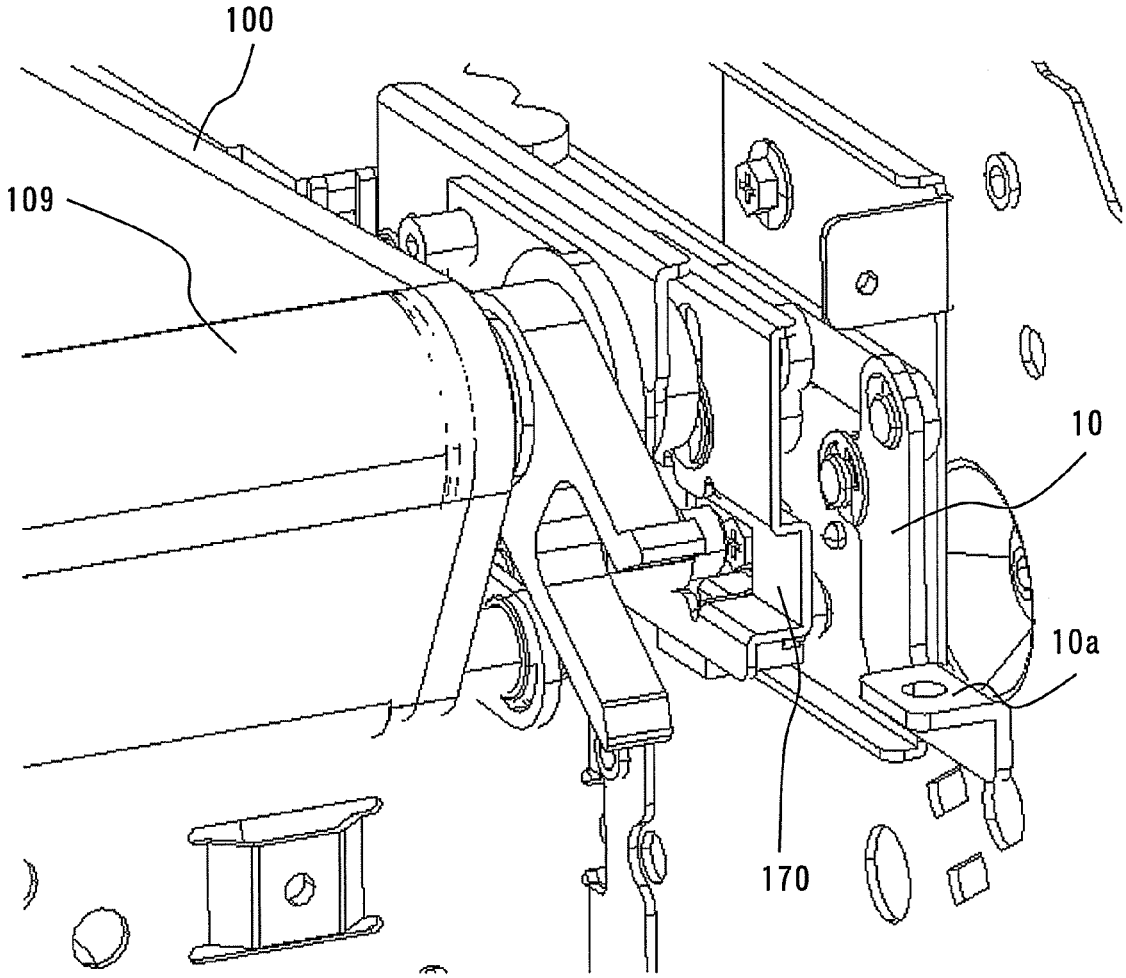
FIG. 5 is a view showing a state where the lifting lever has been turned downward to set the transfer belt unit to a non-transfer position (reference position or dismount position)

Now, an embodiment of the present invention will be described with reference to the accompanying drawings. FIG. 1 is an outline view showing an image forming apparatus to which an embodiment of a transfer belt unit mounting/dismounting device according to the present invention is applied; FIG. 2 is a view showing a relationship between the frames of the transfer belt unit mounting/dismounting device of FIG. 1 and the right side guide rail thereof seen in the insertion direction of the transfer belt unit; FIG. 3 is a view showing a state where the transfer belt unit is inserted into the left and right guide rails; FIG. 4 is a view showing a state where a operation terminal of a lifting lever has been turned upward to set the transfer belt unit to a transfer position; FIG. 5 is a view showing a state where the lifting lever has been turned downward to set the transfer belt unit to a non-transfer position (reference position or dismount position); and FIGS. 6 to 10 are views illustrating the operation of each component of the guide rail moving mechanism interlocking with the lifting lever shown in FIGS. 4 and 5. The transfer belt unit mounting/dismounting device according to the present embodiment has a role of mounting and dismounting a transfer belt unit to and from an image forming apparatus.

When mounting a transfer belt unit 100 shown in FIG. 1 to an image forming apparatus 300, for example, the transfer belt unit 100 is inserted into a unit insertion port 105 of the image forming apparatus 300 in a direction of an arrow DD. At this time, an operation terminal 10*a* of the lifting lever 10 is set to a lower position shown in FIG. 5. The unit insertion port 105 is supported by frames 101, 102 and 103, and left and right guide rails (guide sections, guide means) 160 and 170 extending inside the image forming apparatus 300 are mounted liftably to the left and right frames 101 and 102 by retaining members (shafts or E-rings) respectively. The cross sections of these guide rails 160 and 170 have a U-shape respectively, and openings thereof are arranged so as to be opposed to each other. That is, the guide rails 160 and 170 are arranged so as to be substantially plane-symmetrical to a virtual vertical plane extending through the center of the unit insertion port 105. In addition, in a predetermined position of the guide surface that guides the transfer belt unit from above in the guide rail, there is formed a pushing edge 170*c* that positions the transfer belt unit with respect to the image forming apparatus by supporting a positioning shaft (protrusion) 130 provided in the transfer belt unit while cooperating with a pushing edge 170*d* (that supports the positioning shaft from below). As described above, the guide rails are provided in predetermined mounting positions in the image forming apparatus to guide the transfer belt unit inserted in a predetermined direction by the guide surface. The pushing edge 170*c* that positions the transfer belt unit located in a predetermined position on the guide surface with respect to the image forming apparatus (by supporting it from above) is formed on the guide surface.

In addition, according to the present embodiment, a plurality of the pushing edges 170*c* (pushing edges 170*d*) are provided in mutually different positions in a predetermined direction of the guide rail (here, each in the vicinity of both end positions of the guide rail). Therefore, the posture of the transfer belt unit mounted to the image forming apparatus 300 can be defined with a high accuracy.

Figure 8:
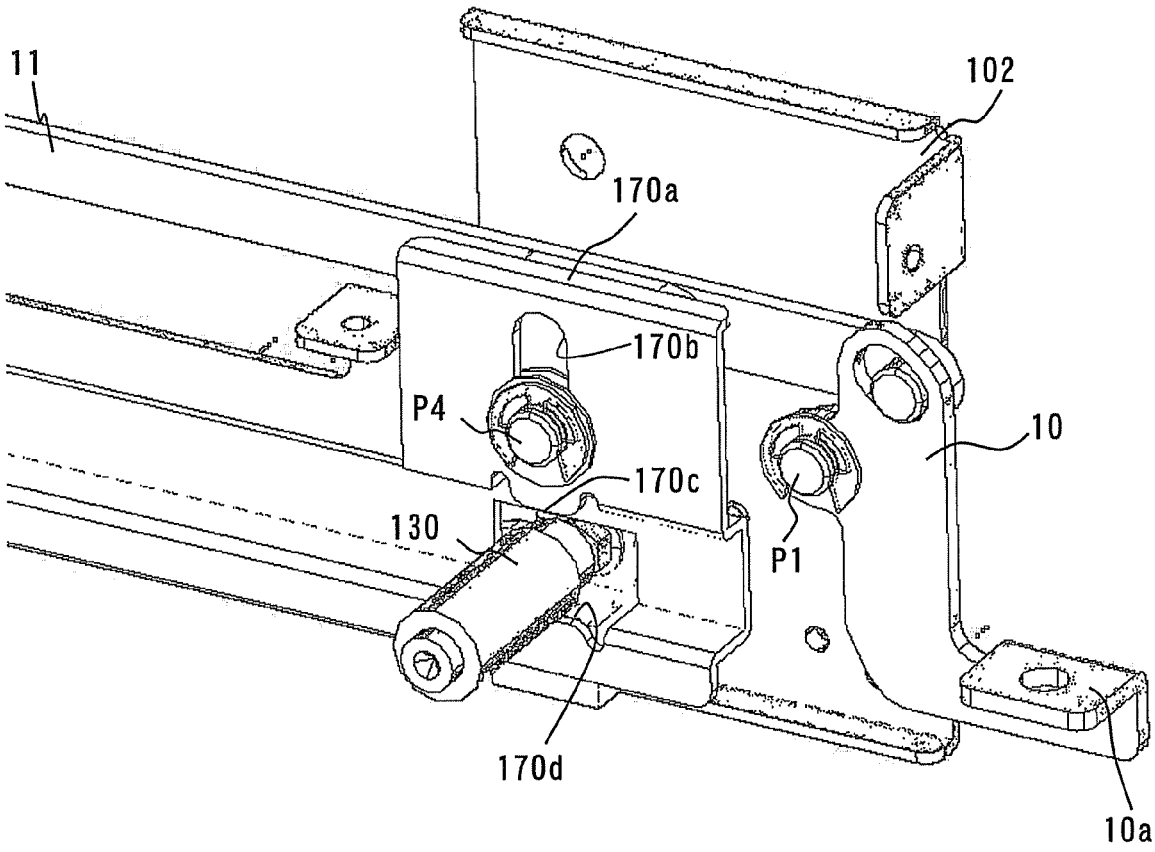
FIG. 8 is a view illustrating a relationship among the frame, the guide rail and positioning shafts of the transfer belt unit in a case where the transfer belt unit has been moved to the non-transfer position by turning the operation terminal of the lifting lever downward as shown in FIGS. 5 and 6.
Figure 9:
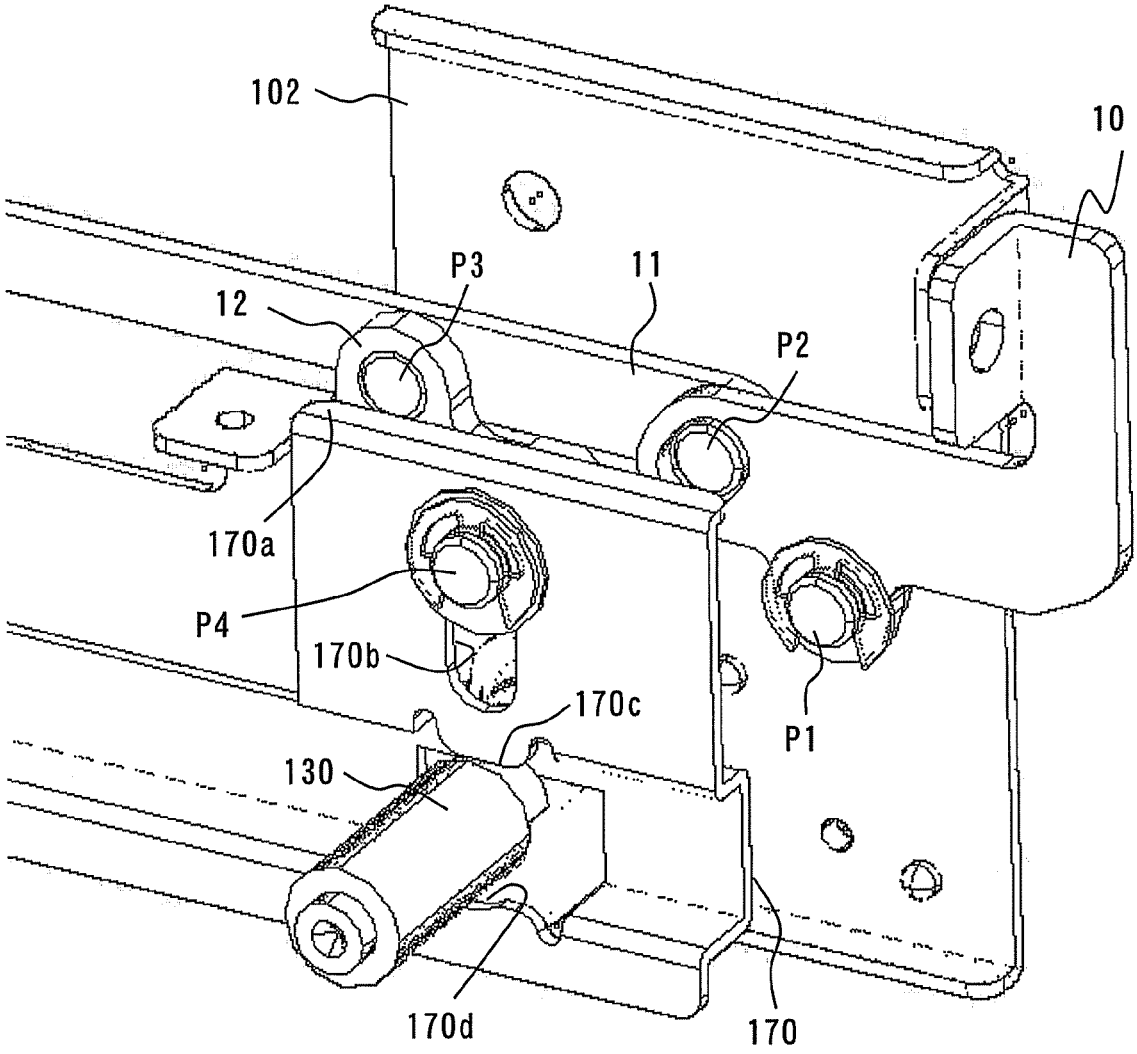
FIG. 9 is a view illustrating a relationship among the frame, the guide rail and the positioning shafts of the transfer belt unit in a case where the transfer belt unit has been moved to the transfer position by turning the operation terminal of the lifting lever upward as shown in FIGS. 4 and 7.
Figure 10:
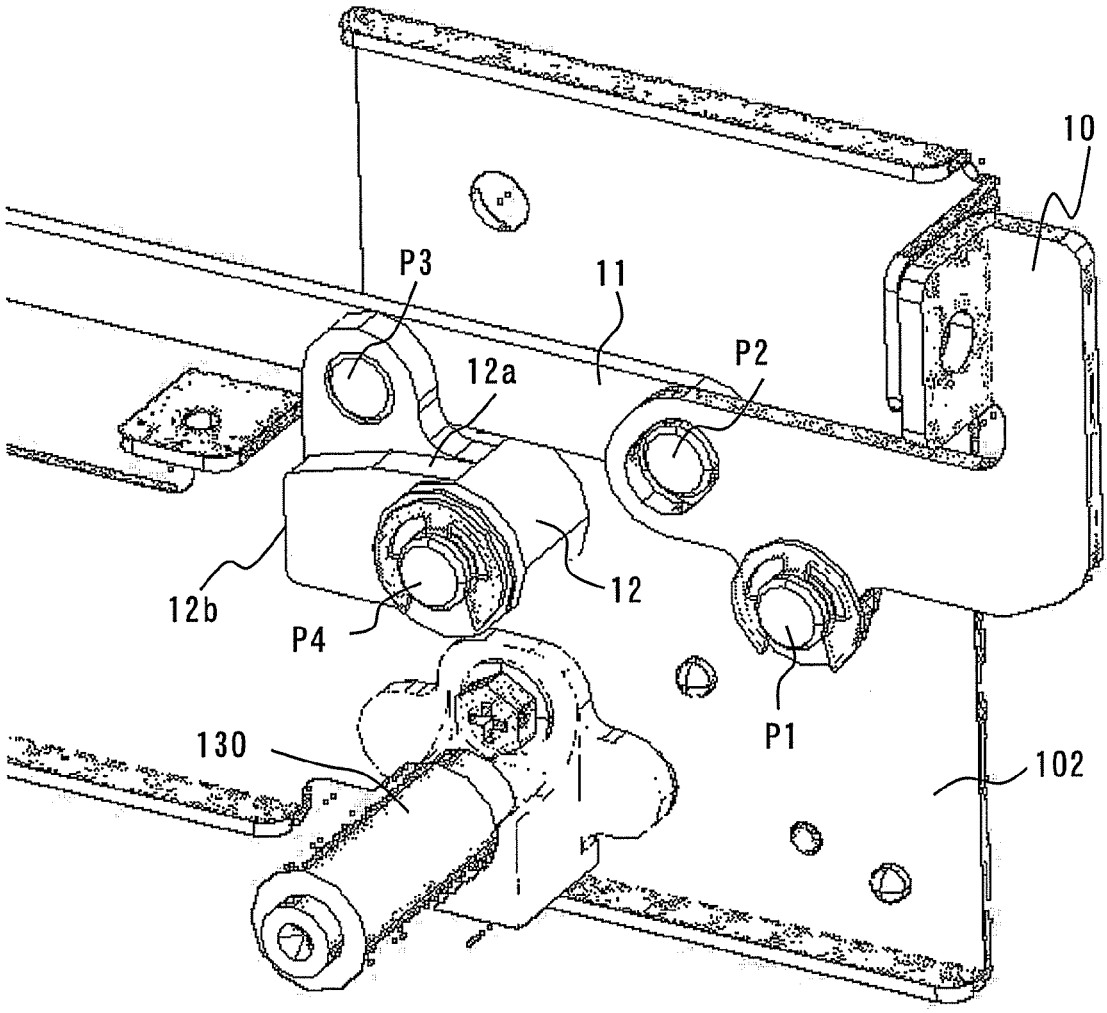
FIG. 10 is a view showing a state where the guide rail is omitted from the case of FIG. 9.

When inserting the above transfer belt unit 100 into the image forming apparatus 300, first the positioning shafts 130 arranged on the left and right side surfaces of the transfer belt unit 100 (only the positioning shaft 130 arranged on the right side surface of the transfer belt unit 100 is shown in FIGS. 8 to 10) are inserted into the U-shaped portions of the guide rails 160 and 170 to push the transfer belt unit 100 horizontally into the inside of the image forming apparatus 300. Incidentally, in this example, the positioning shafts 130 are arranged in each of four positions before and behind the right side surface of the transfer belt unit 100 as well as before and behind the left side surface thereof. When the transfer belt unit 100 reaches a reference position (a position where the positioning shaft 130 is opposed to the pushing edge 170*c* or 170*d* as shown in FIGS. 8 and 9), the operation terminal 10*a* of the lifting lever 10 is turned upward as shown in FIG. 4.

When the lifting lever 10 is turned upward, the guide rails 160 and 170 are lowered to push the positioning shafts downward, thereby setting the transfer belt unit 100 to a transfer position. When the transfer belt unit 100 is set to the transfer position, the transfer belt 109 of the transfer belt unit 100 comes into contact with a photo conductor drum (not shown) to enable transfer. In addition, when the lifting lever 10 is turned downward as shown in FIG. 5, in a state where the transfer belt unit 100 has been set to the transfer position, the guide rails 160 and 170 are raised to lift the positioning shafts upward, thereby separating the transfer belt 109 of the transfer belt unit 100 from the photo conductor drum and positioning the transfer belt unit 100 in a non-transfer position. When the transfer belt unit 100 is positioned in the non-transfer position, the transfer belt unit 100 can be removed from the guide rails to the outside.

Now, the above operations will be described further in detail with reference to FIGS. 6 to 10. When the operation terminal 10*a* of the lifting lever 10 is turned upward (refer to FIGS. 4, 7, 9 and 10), the lifting lever 10 turns, as shown in FIG. 10 where the guide rail 170 is omitted, around a shaft P1 to move a connecting lever 11 connected at a shaft P2 into the back of the transfer belt unit mounting/dismounting section. When the connecting lever 11 is moved into the back, a cam 12 connected to the connecting lever 11 by a shaft P3 is turned around a shaft P4 and is set so that the cam surface 12*a* comes above.

Figure 6:
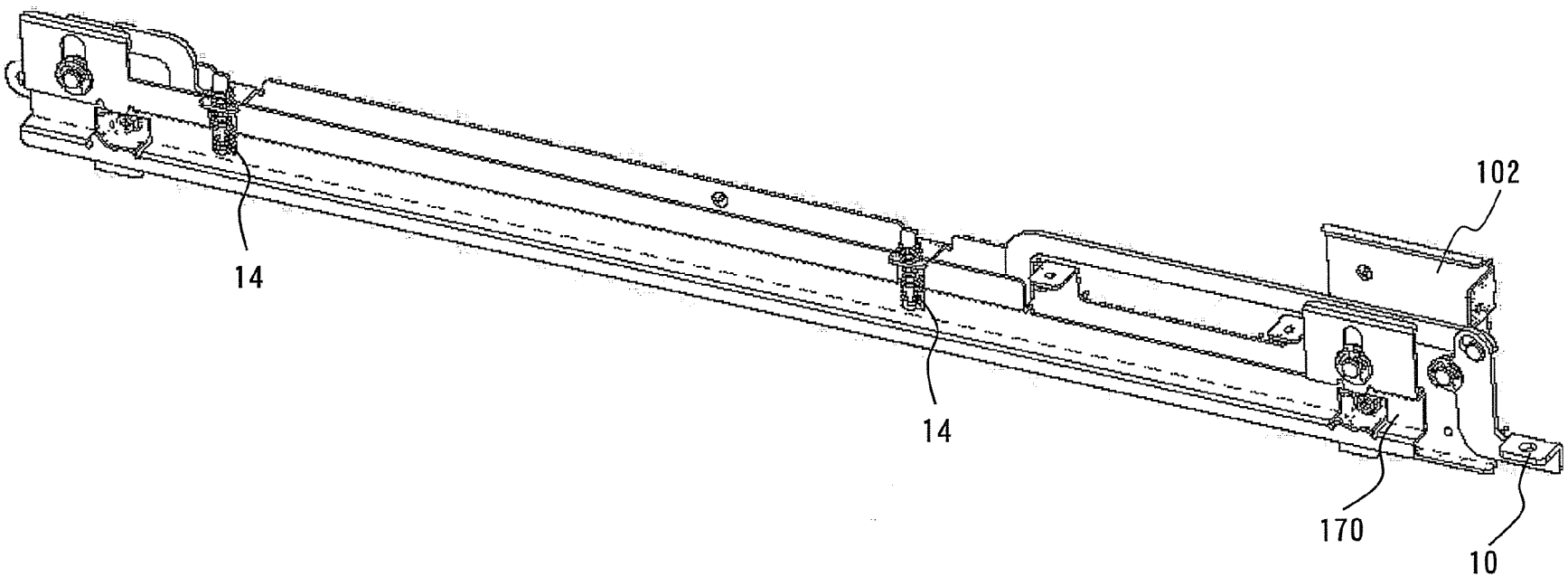
FIG. 6 is a view illustrating a relationship among the frame, the guide rail and a compression spring in a case where the transfer belt unit has been moved to the non-transfer position by turning the operation terminal of the lifting lever downward as shown in FIG. 5.
Figure 7:
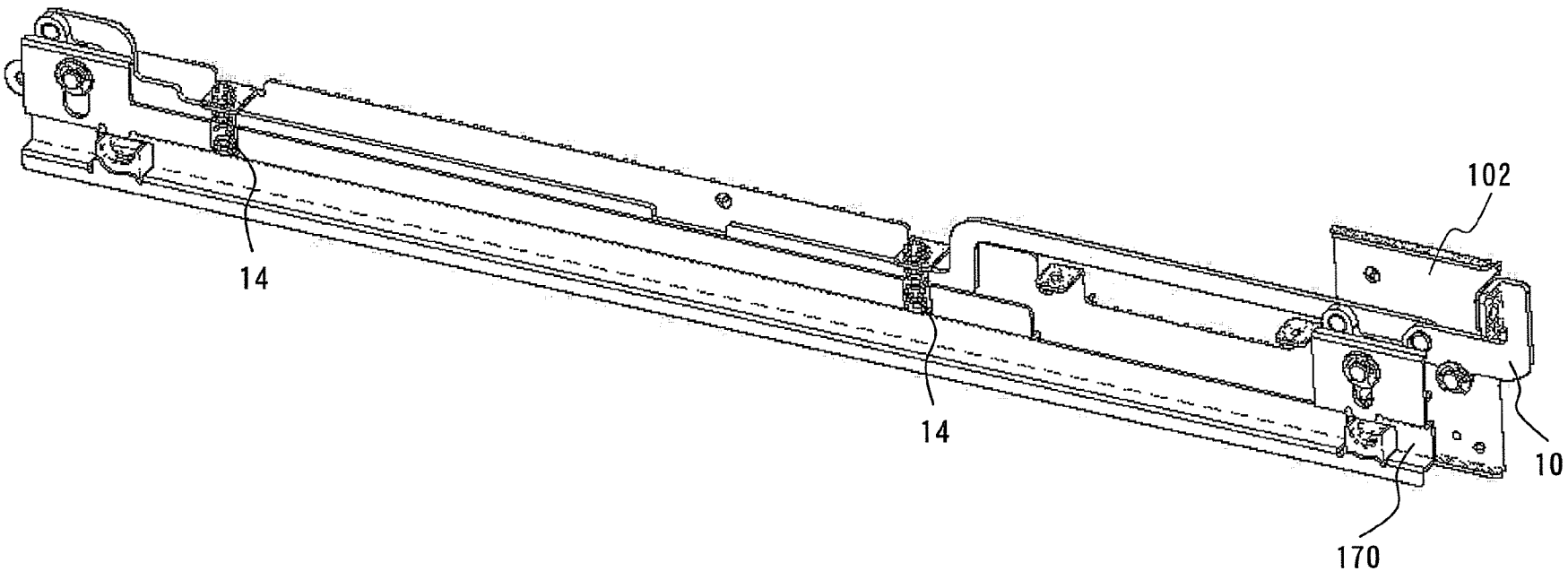
FIG. 7 is a view illustrating a relationship among the frame, the guide rail and the compression spring in a case where the transfer belt unit has been moved to the transfer position by turning the operation terminal of the lifting lever upward as shown in FIG. 4.

On the other hand, as shown in FIG. 7, the guide rail 170 is pushed downward by a compression spring 14. In this case, since the lower surface of a fold 170*a* of the guide rail 170 lies, as shown in FIG. 9, on the cam surface 12*a* of the cam 12, pushing force is applied downward to the guide rail 170 by the compression spring 13, thereby pushing down the guide rail 170 to a predetermined position (second position) in a longitudinal direction of an elongate hole 170b put in the shaft P4 (FIG. 6). Using this downward pushing force applied by the compression spring 13, the pushing edge 170*c* (first positioning section, first positioning means) of the guide rail 170 pushes down the positioning shaft 130 of the transfer belt unit 100, thereby setting the transfer belt unit 100 to a transfer position and enabling a transfer operation. At this time, the pushing edge 170*d* (second positioning section, second positioning means) is preferably spaced apart from the positioning shaft 130. In addition, the pushing edge 170*d* is formed like an upwardly opening triangular groove (concave) to guide the positioning shaft 130 of the transfer belt unit 100 smoothly with respect to the pushing edge 170*d*, thereby realizing a high-accuracy positioning. In this manner, the pushing edge 170*d* positions the transfer belt unit with respect to the image forming apparatus by cooperating with the pushing edge 170*c* in the guide rail moved to the second position by the guide rail moving mechanism (moving means).

On the contrary, in a state where the transfer belt unit 100 lies in a transfer position as shown in FIG. 9, when the operation terminal 10*a* of the lifting lever 10 is turned downward as shown in FIG. 8, the cam surface 12*b* of the cam 12 comes above, as can be seen from FIG. 10. Accordingly, the lower surface of the fold 170*a* of the guide rail 170 is pushed up by the cam surface 12*b* of the cam 12 against the pushing force of the compression spring 13 (refer to FIGS. 7 and 8). At this time, a space is preferably formed between the pushing edge 170*c* and the positioning shaft 130. In this manner, the positioning shaft 130 of the transfer belt unit 100 is pushed up by the pushing edge 170*c* of the guide rail 170, and the transfer belt unit 100 is returned to a non-transfer position (first position) (including the reference position). Accordingly, the transfer belt unit 100 is brought into the same state as the time of insertion and is removable via the reference position. In addition, in the extension portion of the above connecting lever 11, there are arranged a cam 12 interlocking with the connecting lever 11 and a fold 170*a* of the guide rail 170 similarly as in the above case. In this manner, the guide rail moving mechanism moves the guide rail between the first position for guiding the insertion of the transfer belt unit in a predetermined direction by the guide surface and the second position for positioning the transfer belt unit by the pushing edge 170*d* and pushing edge 170*c*.

In the above description, the guide rail 170 on the right side of the insertion direction of the transfer belt unit 100 indicated by an arrow DD in FIG. 1 (rear side seen from the front face (front side) of the image forming apparatus 300) and the components 10, 11, 12 and 14 constituting the guide rail moving mechanism for the guide rail 170 have been described, however, also on the left side of the insertion direction DD of the transfer belt unit 100 in FIG. 1 (front side of the image forming apparatus 300), there are arranged a similar guide rail 160 and a guide rail moving mechanism (moving means) for the guide rail 160. That is, the guide rails 160 and 170 and the guide rail moving mechanisms that move the guide rails 160 and 170 up and down are arranged so as to be substantially plane symmetrical with respect to a virtual vertical plane extending through the center of the unit insertion port 105.

As a matter of course, when the left and right guide rails 160 and 170 and the guide rail moving mechanisms corresponding thereto are arranged so as to be plane symmetrical to each other with respect to the insertion direction DD of the transfer belt unit 100 in FIG. 1, the left and right lifting levers are preferably connected to each other by a connecting shaft (not shown) so that either of the lifting levers can be operated. In addition, it goes without saying that the operation terminal of either the left or right lifting lever can be omitted, when the guide rails are connected by the connecting shaft to each other.

In addition, according to the present embodiment, there can be also provided an image forming apparatus comprising: a transfer belt unit mounting/dismounting device that has advantages as described above; a photo conductor that is provided below the mounting position of the transfer belt unit in the transfer belt mounting/dismounting device and transfers a toner image onto a belt surface of the transfer belt constituting the transfer belt unit; and a transfer roller that transfers the toner image transferred onto the belt surface of the transfer belt to a sheet.

The present invention has been described in accordance with the specific embodiment, it is obvious to those skilled in the art that various changes and modifications may be made without departing from the spirit and scope of the present invention.

As described above in detail, according to the present invention, there can be provided a transfer belt unit mounting/dismounting device constituted by a decreased number of component parts capable of using the guide rails not only to guide the insertion of the transfer belt unit into the transfer belt unit mounting/dismounting section, but also to set the transfer belt unit to a transfer position and to return it to a non-transfer section.

What is claimed is:

1. A transfer belt unit mounting/dismounting device that mounts and dismounts a transfer belt unit to and from an image forming apparatus, comprising:

a guide section that is provided in a predetermined mounting position of the image forming apparatus to guide a transfer belt unit inserted in a predetermined direction by a guide surface, the guide surface having first positioning sections thereon that are formed to position the transfer belt unit located in a predetermined position on the guide surface with respect to the image forming apparatus;

a moving mechanism that moves the guide section between a first position for guiding the insertion of the transfer belt unit in the predetermined direction by the guide surface and a second position for positioning the transfer belt unit by the first positioning sections; and second positioning sections that cooperate with the first positioning sections in the guide section moved to the second position by the moving mechanism to position the transfer belt unit with respect to the image forming apparatus, wherein each of the first positioning sections is a convex that is formed in the predetermined position of the guide surface and positions the transfer belt unit with respect to the image forming apparatus by supporting a protrusion provided in the transfer belt unit cooperating with each of the second positioning sections.

2. The transfer belt unit mounting/dismounting device according to claim 1, wherein each of the second positioning sections is formed like an upwardly opening concave groove.

3. The transfer belt unit mounting/dismounting device according to claim 1, wherein each of the second positioning sections is formed like an upwardly opening triangular groove.

4. The transfer belt unit mounting/dismounting device according to claim 1, wherein a plurality of the first and second positioning sections are provided in mutually different positions in the predetermined direction.

5. The transfer belt unit mounting/dismounting device according to claim 1, wherein the first positioning sections are provided each in the vicinity of both end positions in the predetermined direction of the guide section.

6. A transfer belt unit mounting/dismounting device that mounts and dismounts a transfer belt unit to and from an image forming apparatus, comprising:

a guide section that is provided in a predetermined mounting position of the image forming apparatus to guide a transfer belt unit inserted in a predetermined direction by a guide surface, the guide surface having first positioning sections thereon that are formed to position the transfer belt unit located in a predetermined position on the guide surface with respect to the image forming apparatus;

a moving mechanism that moves the guide section between a first position for guiding the insertion of the transfer belt unit in the predetermined direction by the guide surface and a second position for positioning the transfer belt unit by the first positioning sections; and second positioning sections that cooperate with the first positioning sections in the guide section moved to the second position by the moving mechanism to position the transfer belt unit with respect to the image forming apparatus, wherein the first positioning sections are formed on the guide surface that guides the transfer belt unit in the guide section from above, and the moving mechanism moves the guide section up and down.

7. The transfer belt unit mounting/dismounting device according to claim 6, wherein a plurality of the first and second positioning sections are provided in mutually different positions in the predetermined direction.

8. The transfer belt unit mounting/dismounting device according to claim 6, wherein the first positioning sections are provided each in the vicinity of both end positions in the predetermined direction of the guide section.

9. A transfer belt unit mounting/dismounting method of mounting and dismounting a transfer belt unit to and from an image forming apparatus, comprising:

supporting the transfer belt unit from one of above and below by first positioning sections that are formed on a guide surface to position the transfer belt unit with respect to the image forming apparatus, the transfer belt unit being located in a predetermined position of on a guide surface of a guide section that guides the transfer belt unit inserted in a predetermined direction with respect to a predetermined mounting position in the image forming apparatus; and then supporting the transfer belt unit from the other of above and below by second positioning sections that position the transfer belt unit with respect to the image forming apparatus by cooperating with the first positioning sections in the guide section, the first positioning sections having been moved to a second position by a moving mechanism that moves the guide section between a first position for guiding the insertion of the transfer belt unit in the predetermined direction by the guide surface and a second position for positioning the transfer belt unit by the first positioning sections, wherein each of the first positioning sections is a convex that is formed in the predetermined position of the guide surface and positions the transfer belt unit with respect to the image forming apparatus by supporting a protrusion provided in the transfer belt unit cooperating with each of the second positioning sections.

10. The transfer belt unit mounting/dismounting method according to claim 9, wherein the first positioning sections are formed on the guide surface that guides the transfer belt unit in the guide section from above, andthe moving mechanism moves the guide section up and down.

11. The transfer belt unit mounting/dismounting method according to claim 9, wherein each of the second positioning sections is formed like an upwardly opening concave groove.

12. The transfer belt unit mounting/dismounting method according to claim 9, wherein each of the second positioning sections is formed like an upwardly opening triangular groove.

13. The transfer belt unit mounting/dismounting method according to claim 9, wherein a plurality of the first and second positioning sections are provided in mutually different positions in the predetermined direction.

* * * * *